US008337183B2

(12) United States Patent
Milliff et al.

(10) Patent No.: US 8,337,183 B2
(45) Date of Patent: Dec. 25, 2012

(54) OIL RETURN VALVE FOR A SCROLL COMPRESSOR

(75) Inventors: Tracy L. Milliff, Arkadelphia, AR (US); Thomas R. Barlto, Arkadelphia, AR (US); Edward A. Tomayko, Arkadelphia, AR (US); Joe T. Hill, Arkadelphia, AR (US); Carlos Zamudio, Lyons (FR); Zili Sun, Arkadelphia, AR (US); Gene M. Fields, Arkadelphia, AR (US); Gregory W. Hahn, Arkadelphia, AR (US); John R. Williams, Bristol, VA (US)

(73) Assignee: Danfoss Scroll Technologies, LLC, Arkadelphia, AR (US)

( * ) Notice: Subject to any disclaimer, the term of this patent is extended or adjusted under 35 U.S.C. 154(b) by 583 days.

(21) Appl. No.: 12/563,198

(22) Filed: Sep. 21, 2009

(65) Prior Publication Data

US 2011/0070114 A1 Mar. 24, 2011

(51) Int. Cl.

| | |
|---|---|
| ***F03C 2/00*** | (2006.01) |
| ***F04C 2/00*** | (2006.01) |
| ***F04C 18/00*** | (2006.01) |

(52) U.S. Cl. ..... 418/55.6; 418/55.5; 418/57; 418/94; 418/270; 418/DIG. 1

(58) Field of Classification Search ..... 418/88, 418/94, 55.1–55.6, 57, 270, DIG. 1; 417/410.5, 417/902

See application file for complete search history.

(56) References Cited

U.S. PATENT DOCUMENTS

| | | | | |
|---|---|---|---|---|
| 6,309,198 | B1 * | 10/2001 | Zamudio et al. | 418/55.6 |
| 6,599,109 | B2 * | 7/2003 | Hugenroth et al. | 418/55.6 |
| 2009/0081062 | A1 * | 3/2009 | Upadhye et al. | 418/55.5 |

* cited by examiner

*Primary Examiner* — Theresa Trieu

(74) *Attorney, Agent, or Firm* — Carlson, Gaskey & Olds, PC

(57) ABSTRACT

A valve for selectively allowing the return of oil from a discharge plenum to a suction plenum includes a passage which is selectively opened or blocked by a valve spool. The valve spool sees a pressure from a discharge pressure location upstream of a discharge check valve on one face, and a discharge pressure from a discharge plenum on an opposed face. While the compressor is running, the two pressures should be relatively equal. The face which sees the pressure from the chamber upstream of the check valve is larger than the face which sees the pressure from the discharge plenum. Thus, when the compressor is running, the valve spool is biased to a first position at which it allows oil return from the discharge plenum to the suction plenum. However, upon shutdown of the compressor, the pressure in the chamber upstream of the discharge valve drops. The valve spool will be driven to a second position at which it blocks communication for oil return.

11 Claims, 2 Drawing Sheets

OIL RETURN VALVE FOR A SCROLL COMPRESSOR

BACKGROUND OF THE INVENTION

This application relates to improvements in a scroll compressor wherein a valve is controlled to open an oil return path when the compressor is running such that oil can be returned from a discharge plenum back to a suction plenum.

Scroll compressors are becoming widely utilized in refrigerant compression applications. In a scroll compressor, first and second scroll members each include a base and a generally spiral wrap extending from the base. The two wraps interfit to define compression chambers. One of the two scroll members is caused to orbit relative to the other, and compression chambers between the wraps are reduced in size. An entrapped refrigerant is compressed.

Of special interest is the control of high oil flow and loss to the system, with very high speed operation. Variable speed scroll compressors can operate from very low to very high speeds. In a low side scroll, a positive displacement oil pump is required for low speed, to assist the typical centrifugal shaft oil pump. As this scroll is then operated at very high speed, excessive oil will be passed through the compression unit. It is desirable to separate this oil inside the compressor and return it to the oil sump in the low side.

SUMMARY OF THE INVENTION

In a disclosed embodiment of this invention, an oil return valve selectively opens and closes a return path for oil from the discharge plenum back to the suction plenum. One face of the oil return valve sees the discharge pressure in a chamber upstream of the check valve, and another face of the oil return valve sees the discharge pressure downstream of the check valve. When the compressor is running, the two pressures will be relatively equal. The first face of the oil return valve is larger than the second face such that as long as the compressor is running the oil return valve is biased to a position where it allows communication between the discharge plenum and the suction plenum. However, when the compressor stops, the check valve typically closes. In known scroll compressors, the two scroll members move out of contact, and the pressure upstream of the check valve quickly moves towards suction pressure. Now, the pressure on the first face of the oil return valve is lower than the higher pressure in the discharge plenum. The oil return valve is then biased to a second position, and communication between the discharge plenum and suction plenum is blocked. At this point, the oil can no longer return to the suction plenum. Also, the pressure in the discharge plenum will not leak back through the return path.

In one embodiment the oil return valve is machined into a chamber formed within a non-orbiting scroll member. A second embodiment, a valve housing, is positioned in a chamber in the non-orbiting scroll member and receives the oil return valve. The second embodiment may be somewhat easier to achieve in that precise machining of the housing is not required.

These and other features of the present invention can be best understood from the following specification and drawings, the following of which is a brief description.

DETAILED DESCRIPTION OF THE PREFERRED EMBODIMENT

Figure 1:
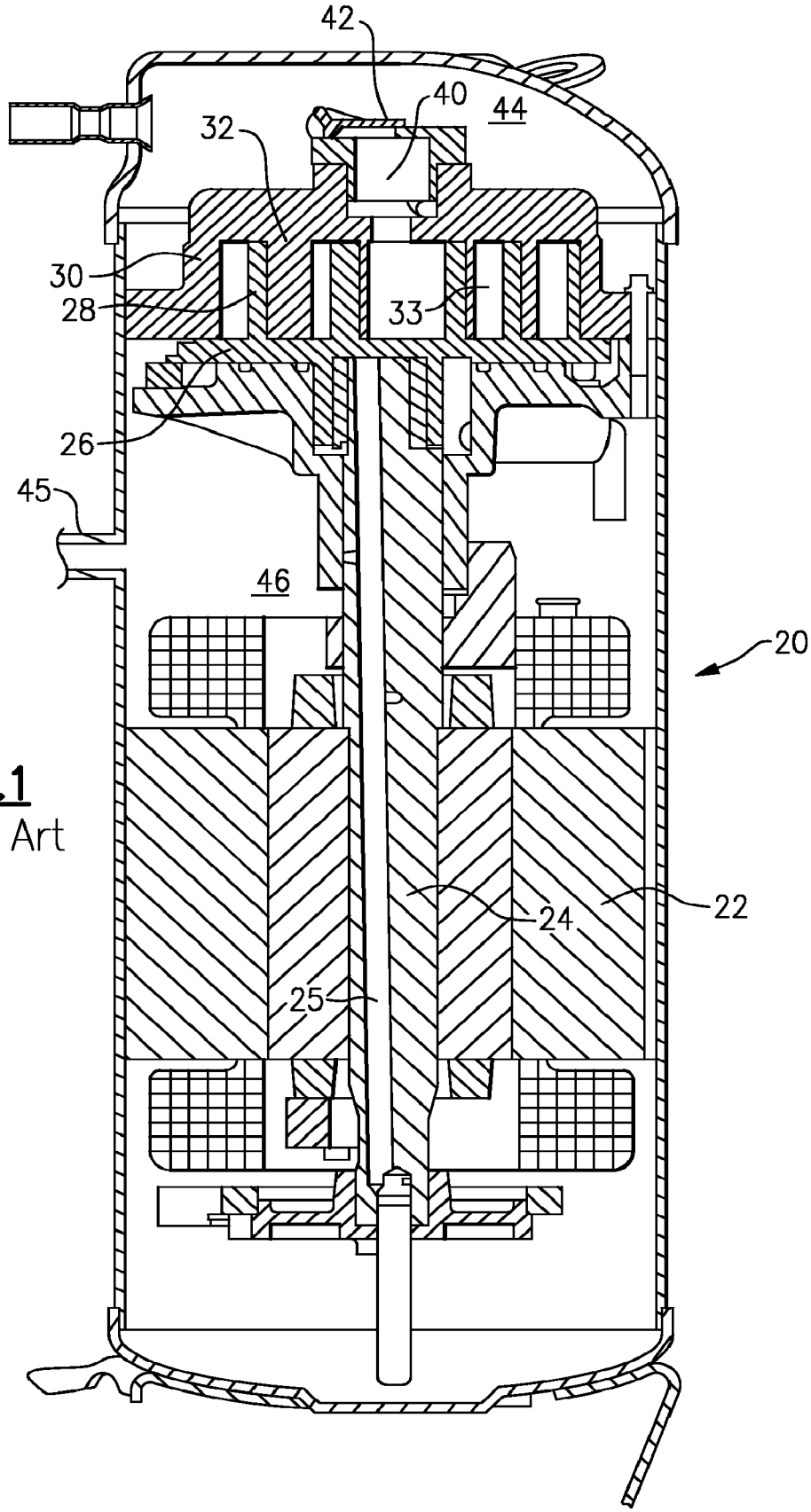
FIG.1 Prior Art
FIG. 1 shows a prior art scroll compressor.

FIG. 1 shows a prior art scroll compressor 20. As known, an electric motor 22 drives an orbiting shaft 24 to rotate. An orbiting scroll member 26 is caused to orbit relative to a non-orbiting scroll member 30. As known, the orbiting scroll member 26 has a wrap 28 and the non-orbiting scroll member 30 has a wrap 32. The wraps 28 and 30 interfit to define compression chambers 33. An oil passage 25 is formed within the rotating shaft 24 and delivers oil upwardly through passages into the compression chambers 33. Compressed refrigerant from the compression chambers 33 moves into a discharge chamber 40, and through a discharge valve 42 into a discharge plenum 44. As also known, a suction port 45 directs refrigerant into a suction plenum 46. In this embodiment, the base of the non-orbiting scroll 30 provides a seal to separate plenums 44 and 46. This application extends to compressors wherein a separate plate provides this separation.

As refrigerant moves through the check valve 42, oil may be entrained. This oil may separate within the discharge plenum 44. As mentioned above, there have been challenges in returning the separated oil.

Figure 2:
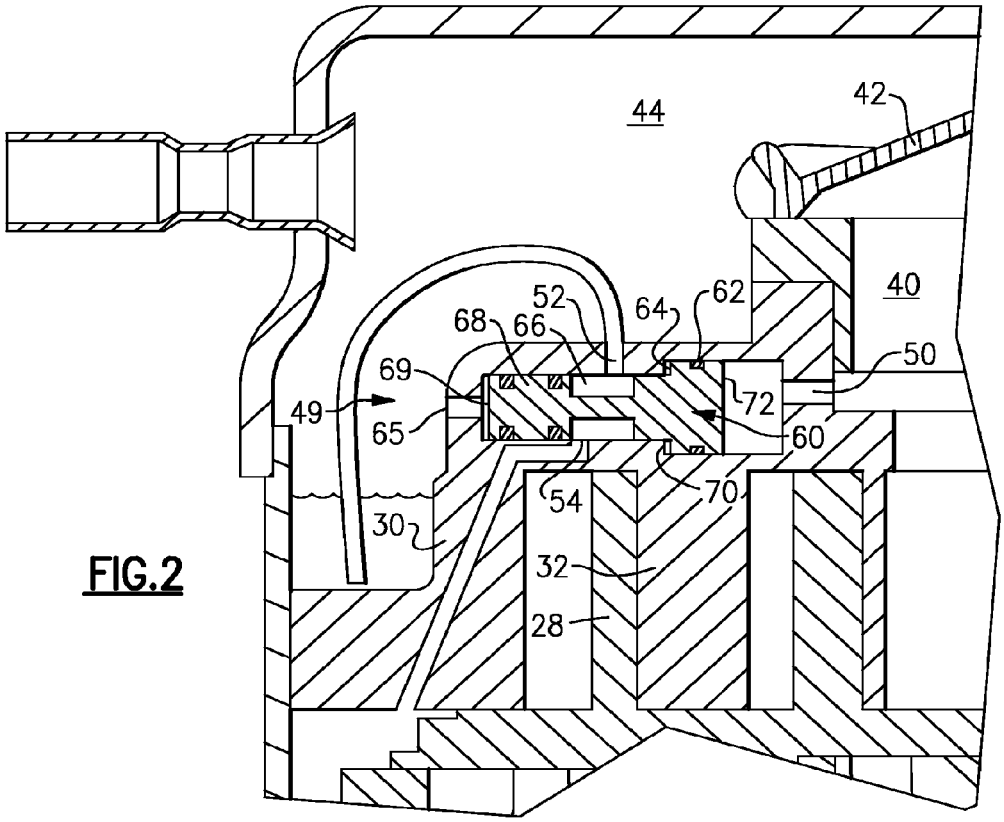
FIG. 2 shows a first embodiment of the present invention.

As shown in FIG. 2, in a first embodiment 49 of this invention a tap 50 extends to the check valve chamber 40. Thus, refrigerant upstream of the check valve 42 is directed against a face 72 of a valve spool 60. The face 72 is part of an enlarged portion 62. Pressure from the discharge plenum 44 is directed through a tap 65 to a face 69 on a small portion 68 of the valve spool 60.

In the position shown in FIG. 2, the compressor is running. Thus, the pressure from tap 50 will be high, and approximately equal to the pressure from tap 65. The valve spool is biased to the left, due to the larger face 72. Oil can return from the passage 52 through the space 66, to the passage 54 and back to the suction plenum 46.

However, upon shutdown, the check valve 42 will quickly close. The scroll members will separate, and the pressure upstream of the check valve 42 will drop. The pressure in chamber 44 will remain high. Once the pressure in the tap 50 has dropped, the pressure from tap 65 will quickly exceed the pressure in tap 50. At this point, the valve spool 60 will be driven to the right. When the valve spool has been driven to the right, the return of flow through tap 52 to tap 54 is blocked.

Figure 3:
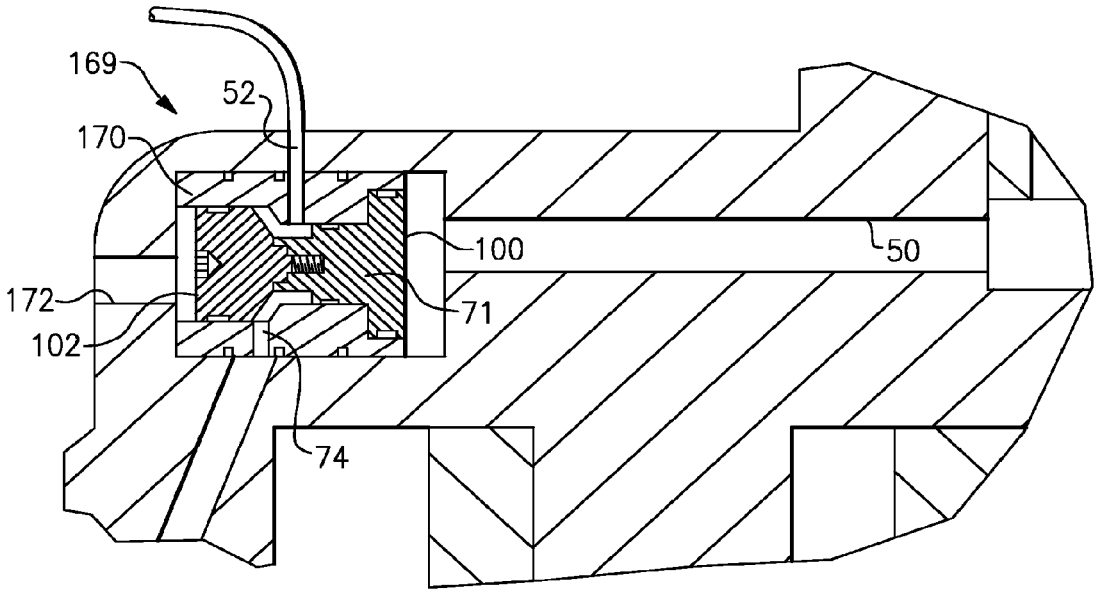
FIG. 3 shows a second embodiment of the present invention.

FIG. 3 shows another embodiment 169 wherein a valve housing 170 is inserted within a cavity of the non-orbiting scroll. The tap 50 still remains and sees an enlarged face 100. The tap 172 from the discharge plenum 44 sees a small face 102. Again, when the compressor is running, the enlarged face 100 will cause the valve spool 71 to be driven to the leftward position as illustrated, and oil can return from tap 52 to tap 74. However, at shutdown, the valve spool 71 will quickly be driven to the right, blocking this flow.

The present invention thus provides a relatively simple and sure way of allowing oil return when the compressor is running but blocking the return flow of oil when the compressor is shut down.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from its base;

a second scroll member having a base and a generally spiral wrap extending from its base, said wraps of said first and second scroll members interfitting to define compression chambers, said second scroll member being driven to orbit relative to said first scroll member, and said first scroll member having a discharge port communicating to a check valve chamber having a check valve positioned to selectively close said discharge port;

said first and second scroll members being housed within a sealed housing, and a separating member defining a suction chamber which is separated from a discharge chamber, said check valve communicating flow from said discharge port into said discharge chamber; and a oil return path communicating a passage from said discharge chamber, through a valve cavity, into a passage to said suction chamber, a valve spool moveable within said valve cavity, said valve spool having a tap to pressure in said check valve chamber on a first face, and a tap to said discharge chamber on a second face, with said pressure in said check valve chamber acting on said first face to urge said valve spool in a first direction, and said pressure in said discharge chamber acting on said second face to urge said valve spool in a second direction, opposed to said first direction, and said first face having a larger surface area than said second face, such that when said compressor is running, said valve spool is biased to a position allowing communication between said passage from the discharge chamber and said passage to the suction chamber, and said valve spool being biased to close communication between said passage from said discharge chamber and said passage to the suction chamber when the compressor is shut down.

2. The scroll compressor as recited in claim 1, wherein said valve spool has said first and second faces on opposed ends of said valve spool.

3. The scroll compressor as recited in claim 1, wherein said valve cavity is defined by being machined within a body of said first scroll member.

4. The scroll compressor as recited in claim 1, wherein a valve housing is positioned within said first scroll member to define said valve cavity.

5. A method of operating a scroll compressor comprising the steps of:

(a) providing a first scroll member having a base and a generally spiral wrap extending from its base;

(b) providing a second scroll member having a base and a generally spiral wrap extending from its base, said wraps of said first and second scroll members interfitting to define compression chambers, said second scroll member being driven to orbit relative to said first scroll member, and said first scroll member having a discharge port communicating to a check valve chamber having a check valve positioned to selectively close said discharge port;

(c) providing said first and second scroll members within a sealed housing, and a separating member defining a suction chamber separated from a discharge chamber, said check valve communicating flow from said discharge port into said discharge chamber; and (d) providing a passage from said discharge chamber, through a valve cavity, into a passage to said suction chamber, a valve spool moveable within said valve cavity, tapping pressure in said check valve chamber to a first face of said valve spool, and taping said discharge chamber to a second face, with said pressure in said check valve chamber acting on said first face to urge said valve spool in a first direction, and said pressure in said discharge chamber acting on said second face to urge said valve spool in a second direction opposed to said first direction, and said first face having a larger surface area than said second face, such that when said compressor is running, said valve spool is biased to a position allowing communication between said passage from the discharge chamber and said passage to the suction chamber, and said valve spool being biased to close communication between said passage from said discharge chamber and said passage to the suction chamber when the compressor is shut down.

6. The method as recited in claim 5, wherein said valve spool has said first and second faces on opposed ends of said valve spool.

7. The method as recited in claim 5, wherein said valve cavity is defined by being machined within a body of said first scroll member.

8. The method as recited in claim 5, wherein a valve housing is positioned within said first scroll member to define said valve cavity.

9. A scroll compressor comprising:

a first scroll member having a base and a generally spiral wrap extending from its base;

a second scroll member having a base and a generally spiral wrap extending from its base, said wraps of said first and second scroll members interfitting to define compression chambers, said second scroll member being driven to orbit relative to said first scroll member, and said first scroll member having a discharge port communicating to a check valve chamber having a check valve positioned to selectively close said discharge port;

said first and second scroll members being housed within a sealed housing, and a separating member defining a suction chamber which is separated from a discharge chamber, said check valve communicating flow from said discharge port into said discharge chamber;

a oil return path communicating a passage from said discharge chamber, through a valve cavity, into a passage to said suction chamber, a valve spool moveable within said valve cavity, said valve spool having a tap to pressure in said check valve chamber on a first face, and a tap to said discharge chamber on a second face, said first face having a larger surface area than said second face, such that when said compressor is running, said valve spool is biased to a position allowing communication between said passage from the discharge chamber and said passage to the suction chamber, and said valve spool being biased to close communication between said passage from said discharge chamber and said passage to the suction chamber when the compressor is shut down; and said valve spool has said first and second faces on opposed ends of said valve spool.

10. The scroll compressor as recited in claim 9, wherein said valve cavity is defined by being machined within a body of said first scroll member.

11. The scroll compressor as recited in claim 9, wherein a valve housing is positioned within said first scroll member to define said valve cavity.

* * * * *